US010669649B2

(12) United States Patent
Baur et al.

(10) Patent No.: US 10,669,649 B2
(45) Date of Patent: Jun. 2, 2020

(54) THREAD DRAW-OFF NOZZLE

(71) Applicant: Maschinenfabrik Rieter AG, Winterthur (CH)

(72) Inventors: Guenter Baur, Suessen (DE); Michael Basting, Suessen (DE)

(73) Assignee: MASCHINENFABRIK RIETER AG, Winterthur (CH)

( * ) Notice: Subject to any disclaimer, the term of this patent is extended or adjusted under 35 U.S.C. 154(b) by 86 days.

(21) Appl. No.: 15/773,582

(22) PCT Filed: Nov. 2, 2016

(86) PCT No.: PCT/EP2016/076322
§ 371 (c)(1),
(2) Date: May 4, 2018

(87) PCT Pub. No.: WO2017/076846
PCT Pub. Date: May 11, 2017

(65) Prior Publication Data

US 2018/0320293 A1 Nov. 8, 2018

(30) Foreign Application Priority Data

Nov. 6, 2015 (DE) ..... 10 2015 119 114

(51) Int. Cl.
*D01H 4/40* (2006.01)
*D01H 4/10* (2006.01)

(52) U.S. Cl.
CPC ..... *D01H 4/40* (2013.01); *D01H 4/10* (2013.01)

(58) Field of Classification Search
CPC .. D01H 4/40; D01H 4/04; D01H 4/38; D01H 4/10; D01H 4/48; D01H 13/08; D01H 13/045
(Continued)

(56) References Cited

U.S. PATENT DOCUMENTS 6,269,623 B1 * 8/2001 Phoa ..... D01H 4/40 57/417
6,286,295 B1 * 9/2001 Lang ..... D01H 4/40 57/416

(Continued)

FOREIGN PATENT DOCUMENTS

DE 32 39 289 A1 4/1984
DE 4205485 A1 * 8/1993 ..... D01H 4/40

(Continued)

OTHER PUBLICATIONS

English language translation of DE4205485 to Wassenhofen, provided via espacenet.com, last visited Sep. 19, 2019.*

(Continued)

*Primary Examiner* — Shaun R Hurley
*Assistant Examiner* — Patrick J. Lynch
(74) *Attorney, Agent, or Firm* — Dority & Manning, P.A.

(57) ABSTRACT

A thread draw-off nozzle for an open-end rotor spinning device includes a front surface, a nozzle bore, and a funnel-shaped yarn deflection surface connecting the front surface and the nozzle bore. The front surface adjoins the yarn deflection surface. The front surface and the yarn deflection surface form an effective diameter ($D_W$) of the thread draw-off nozzle. The effective diameter ($D_W$) of the thread draw-off nozzle is less than 8 mm, and the yarn deflection surface comprises a radius of curvature (R) of less than 2.5 mm.

13 Claims, 3 Drawing Sheets

(58) Field of Classification Search
USPC ..... 57/401, 417, 416, 404, 413, 414
See application file for complete search history.

(56) References Cited

U.S. PATENT DOCUMENTS

| | | | | |
|---|---|---|---|---|
| 6,347,506 | B1 | 2/2002 | Backmeister | |
| 6,389,789 | B1 * | 5/2002 | Preininger | D01H 4/40 57/352 |
| 2003/0221406 | A1 * | 12/2003 | Sonntag | D01H 4/40 57/404 |
| 2011/0315265 | A1 * | 12/2011 | Schermer | D01H 4/40 139/435.1 |
| 2018/0320292 | A1 * | 11/2018 | Baur | D01H 4/10 |

FOREIGN PATENT DOCUMENTS

| | | | | | |
|---|---|---|---|---|---|
| DE | 199 06 111 | A1 | | 10/2000 | |
| DE | 199 49 533 | A1 | | 4/2001 | |
| DE | 103 18 305 | A1 | | 10/2004 | |
| DE | 199 01 147 | B4 | | 4/2010 | |
| GB | 1451133 | A | * | 9/1976 | D01H 4/08 |
| GB | 1568070 | A | * | 5/1980 | D01H 4/40 |
| GB | 2 128 643 | A | | 5/1984 | |

OTHER PUBLICATIONS

German Patent Office Search Report, dated Aug. 26, 2016.
PCT Search Report, dated Jan. 20, 2017.
IPRP, May 8, 2018.

* cited by examiner

THREAD DRAW-OFF NOZZLE

FIELD OF THE INVENTION

The present invention relates to a thread draw-off nozzle for an open-end rotor spinning device with a front surface, a nozzle bore, and a funnel-shaped yarn deflection surface connecting the front surface and the nozzle bore, whereas the front surface adjoins the yarn deflection surface and whereas the front surface and the yarn deflection surface form an effective diameter of the thread draw-off nozzle.

Thread draw-off nozzles have become known in the state of the art in many designs for open-end rotor spinning devices. Such thread draw-off nozzles have the task of deflecting the spun yarn upon being drawn off from the spinning device and giving the drawn-off yarn a false twist. In the freshly spun thread, the true yarn twist is introduced predominantly between the thread draw-off nozzle and the draw-off device, but does not propagate sufficiently into the rotor groove. However, for good spinning stability, it is necessary to achieve the highest possible yarn twist in the area of the rotor groove as well. Thus, the thread draw-off nozzle must, on the one hand, enable the propagation of the true yarn twist into the rotor groove and, on the other hand, give the yarn an additional false twist as much as possible. The false twist and thus spinning stability is greater, as the radius of the yarn deflection surface is greater. Due to the crank-like circulation of the yarn on the thread draw-off nozzle, there is also a comparatively high temperature stress on both the drawn-off yarn and the draw-off nozzles. Thus, the design of the thread draw-off nozzle is of essential importance.

A thread draw-off nozzle with a shortened yarn contact track is known from DE 32 39 289 C2. The shortening of the yarn contact track is achieved by the fact that the upper part of the thread draw-off nozzle, in which it is typical that the funnel-shaped yarn deflection surface merges into the tangentially adjoining front surface, is cut off. This results in a pronounced, circumferential edge at the transition between the yarn deflection surface and the flat front surface. The draw-off force that acts on the spun yarn is to be reduced, and thread breaks are to be avoided.

By contrast, DE 199 01 147 B4 considers such an edge to be disadvantageous, since a high surface pressure is generated upon the crank-like rotation of the thread over such edge. In order to avoid overheating damages at the thread draw-off nozzle, DE 199 01 147 B4 proposes forming the yarn deflection surface with a maximum radius of curvature of 3 mm. At the yarn deflection surface, the front surface is to adjoin tangentially and form a guide surface supporting the yarn, which is considered advantageous.

SUMMARY OF THE INVENTION

A task of the present invention is to propose a thread draw-off nozzle that avoids the overheating of the draw-off nozzle and enables a good propagation of the yarn twist in the rotor groove. Additional objects and advantages of the invention will be set forth in part in the following description, or may be obvious from the description, or may be learned through practice of the invention.

A thread draw-off nozzle for an open-end rotor spinning device features a front surface, a nozzle bore and a funnel-shaped yarn deflection surface that connects the front surface and the nozzle bore. The front surface adjoins the yarn deflection surface, whereas the front surface and the yarn deflection surface form an effective diameter of the thread draw-off nozzle. With this, the front surface and the yarn deflection surface form an entrance-side area of the thread draw-off nozzle, while the nozzle bore forms an exit-side area of the thread draw-off nozzle. The nozzle bore typically features a constant inner cross-section over the length or the axial extension of the thread draw-off nozzle, while the yarn deflection surface features an inner cross-section that is reduced over the axial extension of the thread draw-off nozzle. The front surface is oriented in a manner essentially radial to the nozzle bore, but may also have a curved or conically sloping course that is radially outward.

It is known from the state of the art that, with a small radius of curvature of the yarn deflection surface, the yarn deflection surface can be reduced, and thus the unwanted development of heat can be reduced. However, this improvement in the development of heat is offset by a reduction in the introduced false twist, which in turn prevents the propagation of rotation into the rotor groove. Thus, the reduction of the yarn deflection surface is typically accompanied by a deterioration in spinning stability.

It is now provided that the effective diameter of the thread draw-off nozzle is less than 8 mm, and the yarn deflection surface features a radius of curvature of less than 2.5 mm. The present invention has found that, in addition to the actual yarn deflection surface, the front surface has a significant influence on the propagation of rotation. With the present thread draw-off nozzle, not only the radius of the yarn deflection surface, but at the same time the entire front surface is substantially reduced, such that the overall result is a very small effective diameter. In this case, the combination of a small radius of the yarn deflection surface with the small effective diameter or the smaller front surface brings about a change in the ratio of false rotations to actual rotations, such that significantly more true rotations arrive in the rotor groove. Despite the fact that the false twist is actually lower, the overall rotation of the thread towards the rotor groove can thus be increased, and excellent spinning stability can thus be achieved. At the same time, the development of heat is nevertheless reduced by the short yarn deflection surface and the thread is drawn off more gently.

According to an advantageous additional form of the invention, the head diameter of the thread draw-off nozzle is less than 10 mm. Here, the head diameter is defined as the largest outer diameter of the thread draw-off nozzle. Under certain circumstances, the head diameter can also be equal to the effective diameter; however, as a rule, the head diameter is slightly larger than the effective diameter, such that an additional annular surface adjoins the front surface in a radially outward manner, but this is, as a rule, not in contact with the thread. Due to the very small outer diameter of the thread draw-off nozzle, the frictional heat that arises through the crank-like thread circulating through the thread draw-off nozzle can be dissipated significantly better, since the heat emission of the part of the rotor housing in which the thread draw-off nozzle is stored is not hindered by the thread draw-off nozzle.

It is also advantageous if the yarn deflection surface tangentially adjoins the front surface. Thus, no edges whatsoever are arranged between the yarn deflection surface and the front surface. Thereby, the propagation of the true yarn twist in the rotor groove is further improved. At the same time, the contact force of the thread at the transition from the front surface to the yarn deflection surface is reduced, such that less friction arises, and the temperature stress of the thread is thus reduced. It is also advantageous if the yarn deflection surface tangentially adjoins the nozzle bore.

In order to also introduce a rotation in the thread that further increases spinning stability, it is advantageous if the yarn deflection surface features macrostructures, in particular notches that are arranged in a radial manner. These stimulate the thread in a manner known per se, in order for it to rotate around its longitudinal axis and thereby bring a false twist into the thread in a comparatively thread-saving manner.

It is advantageous for the propagation of rotation into the rotor groove if the notches feature a radially outer notch inlet and a radially inner notch outlet, and the notch outlet is arranged in an entrance area of the nozzle bore. Thus, the notch extends into the nozzle bore and is thereby designed to be comparatively steep. The thread can better enter into the notches, and thus experiences a particularly significant change in length in the circumferential yarn shank. In this case, the change in length and thus also the thread tension tip produced by the notch is greater, as the notch is steeper. Due to the steeper running out of the notches in the nozzle bore, a smoother transition upon reaching and leaving the notch is thereby achieved at the same time, such that negative influences of the notches on yarn quality can be avoided.

It is advantageous if the notch outlet is arranged at a depth of between 0.1 mm and 0.5 mm away from an entrance of the nozzle bore. With such an arrangement of the notch outlet, the thread can be guided into the notches in a particularly secure manner, and a steep notch is achieved.

In addition, it is advantageous if the notches feature a flatter inlet wall and a steeper baffle wall. The thread is thereby securely guided over the inlet wall to the notch base. As a result, the skipping over of the notches by the thread can be avoided.

For this reason, it is also particularly advantageous if a notch bottom that is designed to be flat, preferably even, is arranged between the inlet wall of the notch and the baffle wall. Thus, the inlet wall and the baffle wall do not abut each other directly in the area of the notch base, which, in the state of the art, has often been designed to be rounded. Therefore, the thread entering through the inlet wall runs along the notch in a defined manner, and is securely guided to the notch base. By contrast to this, with V-shaped notches that were previously customary, despite a gently descending inlet wall, it was still the case that the thread does not reach the notch base, but jumps from the inlet wall directly onto the baffle wall.

Preferably, the notch bottom features a width of between 0.16 mm and 0.22 mm, in particular between 0.18 mm and 0.20 mm. The thread can be braked gently during its travel over the notch bottom, and can slide in the direction of the baffle wall. Thus, the yarn is exposed to the effect of the notch securely and over a longer period of time, whereas, at the same time, the yarn-damaging effect of the notches is reduced. It has been found that, with such a width of the notch bottom, an optimal compromise can be achieved between, on the one hand, the effect of the notches (which increases spinning stability) and, on the other hand, the yarn quality.

It is also advantageous if the inlet wall and/or the baffle wall are formed as flat surfaces; that is, non-curved surfaces. Preferably, the notch bottom between the baffle wall and the inlet wall is formed as a flat surface. The thread is thereby guided in a defined manner within the notch over its entire length, and the production of the thread draw-off nozzle is thereby facilitated.

If the inlet wall and/or the baffle wall are formed to be kinked and/or bent, in this manner, a thread treatment that is more gentle than with a non-curved surface can take place. Due to the kinked or bent surface, the steep surface is reduced and, due to a flatter surface, it is continued up to the top side of the nozzle.

According to an additional advantageous embodiment of the thread draw-off nozzle, an angle of the baffle wall to a center notch plane is between 32.5° and 47.5°, preferably between 35° and 45°, more preferably between 37° and 42°. Thereby, the release of the thread after its braking by the baffle wall can likewise be more gentle, and an undefined jumping of the thread can also be avoided. For the secure guidance of the thread up to the notch base or notch bottom, it is also advantageous if the angle of the inlet wall to a center notch plane is between 50° and 65°, preferably between 52° and 60°, more preferably between 54° and 58°.

In the case of a kinked or bent inlet wall and/or baffle wall, it is advantageous if a first angle ($\beta_1$) of a first part of the inlet wall and/or the baffle wall to a center notch plane is between 32.5° and 47.5°, preferably between 35° and 45°, more preferably between 37° and 42°, and a second angle ($\beta_2$) of a second part of the inlet wall (8) and/or the baffle wall (9) to the first part is between 10° and 20°, preferably between 13° and 17°. Thereby, the thread is guided very gently.

For achieving good yarn quality, it is furthermore advantageous if the yarn deflection surface features, in the area of the notch inlets, a circumferential recess, in particular a circumferential, preferably rounded, groove. With this, the recess can be directly adjacent to the notch inlets. It is likewise possible that, through the recess, an upper area of the notches with the original notch inlets is removed, and new notch inlets that are now located in a deeper area of the funnel-shaped yarn deflection surface arise at the transition of the recess to the notch. The recess itself can extend to the front surface of the thread draw-off nozzle, or also only break up the yarn deflection surface. Due to such a recess, any aggressive effect of the notch inlet on the thread can be further reduced. Instead of a circumferential groove, it is also possible to form the recess, for example, through a spherical recess.

In order to securely release the thread after braking, the depth of the notch preferably is between 0.14 mm and 0.25 mm, preferably between 0.16 mm and 0.22 mm and more preferably between 0.16 and 0.20 mm.

BRIEF DESCRIPTION OF THE DRAWINGS

Additional advantages of the invention are described on the basis of the following presented embodiments. The following is shown.

DETAILED DESCRIPTION

Figure 1:
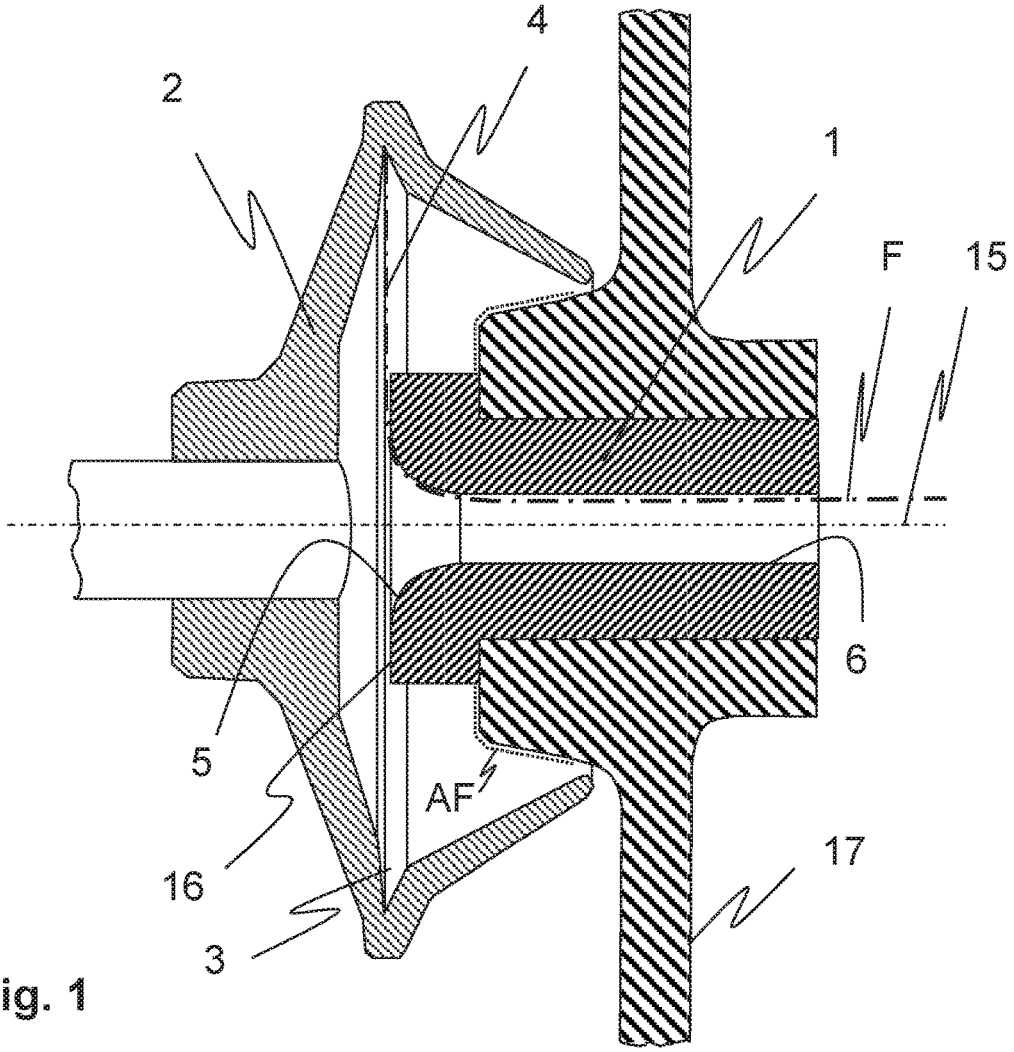
FIG. 1 is a schematic view of an open-end spinning device with a spinning rotor and a draw-off nozzle.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic sectional view of a spinning rotor 2 and a thread draw-off nozzle 1 in an open-end spinning device, which is shown only partially in the present case. To produce a thread F, the spinning rotor 2 is fed in a known manner with a fiber material broken down into individual fibers. During yarn production, the spinning rotor 2 runs at high rotational speeds, such that the fibers that are fed are deposited in the rotor groove 3 of the spinning rotor 2 in the form of a fiber ring. The newly spun thread F is drawn off continuously via the thread draw-off nozzle 1 and, with its end, extends into the rotor groove 3 of the spinning rotor 2. Thus, due to the rotation of the spinning rotor 2, a crank-like circumferential yarn shank 4, in which the fibers deposited in the rotor groove 3 are integrated, arises. The thread draw-off nozzle 1 is mounted in a manner known per se either in an extension or in an insert of a cover element of the rotor housing 17.

The thread draw-off nozzle 1 features, in the customary manner, a cylindrical nozzle bore 6 and a curved yarn deflection surface 5 for the thread F to be drawn off. Finally, a front surface 16 of the thread draw-off nozzle 1 adjoins the yarn deflection surface 5, on the side of the thread draw-off nozzle 1 turned away from the nozzle bore 6. The front surface 16 can be formed to be sloping in different ways, for example, flat, curved or in the direction of the outer diameter of the thread draw-off nozzle 1, which is designated here with head diameter $D_K$. The curved yarn deflection surface 5 and the front surface 16 together form an effective diameter $D_W$ of the thread draw-off nozzle 1, which is in contact with the thread F. The nozzle bore 6 is typically coaxial relative to the axis of rotation 15 of the spinning rotor 2, such that, during its drawing off out of the rotor groove 3, the drawn-off thread F is deflected over the yarn deflection surface 5 by about 90°. As described above, it is desirable that the rotation introduced into the thread propagates as far as possible into the rotor groove 3, in order to achieve the best possible spinning stability.

Figure 2:
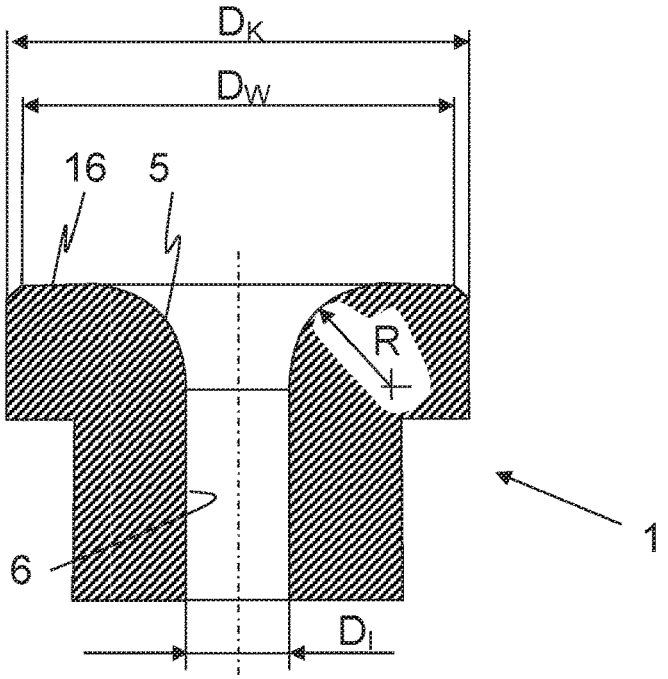
FIG. 2 is a schematic view of a thread draw-off nozzle with a reduced effective diameter.

FIG. 2 shows, in a schematic sectional view, a thread draw-off nozzle 1, which features a yarn deflection surface 5 with a very small radius of curvature R of less than 2.5 mm and a reduced effective diameter $D_W$ of less than 8 mm. Thus, with the present thread draw-off nozzle, the annular front surface 16 is also greatly reduced. While, with conventional thread draw-off nozzles, an excessive reduction of the radius of curvature R has always been avoided, since, at the same time, this has been associated with a reduction in spinning stability, it has now been surprisingly found that good spinning stability can nevertheless be achieved if, at the same time, the front surface 16 or the total effective diameter $D_W$ is reduced. The reason for this is that, due to the special, overall small dimensions, less false twist is introduced into the thread F, but, at the same time, the propagation of the true rotation into the rotor groove 3 is improved at otherwise identical spinning ratios. Thus, with the same geometry of the spinning rotor 2, solely through the use of the thread draw-off nozzle 1 described, without changes in the rotor speed or the delivery speed, it can increase the total rotation of the thread F to the rotor groove. At the same time, the thread F is gently drawn off through the geometry of the thread draw-off nozzle 1, with a very small effective diameter $D_W$. Due to the lower friction on the reduced yarn deflection surface 5 and front surface 16, the thread draw-off tension and, at the same time, the temperature stress of the thread F are reduced.

At the same time, the thread draw-off nozzle 1 shown here also features a particularly small head diameter $D_K$ of less than 10 mm. As can be seen again from FIG. 1, a particular large emission surface AF on the part of the rotor housing 17 projecting into the spinning rotor 2, here an extension of a cover element of the rotor housing, is achieved. Thereby, the frictional heat that arises at the thread draw-off nozzle 1, which was already reduced by the reduced yarn deflection surface 5 can be dissipated even better. The thermal load of the thread draw-off nozzle 1 itself can also be thereby reduced. At the same time, due to the reduced surface temperature at the thread draw-off nozzle 1, damage to the drawn-off thread F and yarn breaks are avoided. This has a particularly advantageous effect with chemical fibers. Likewise, contamination of the thread draw-off nozzle 1 is avoided, particularly with chemical fibers.

Figure 3:
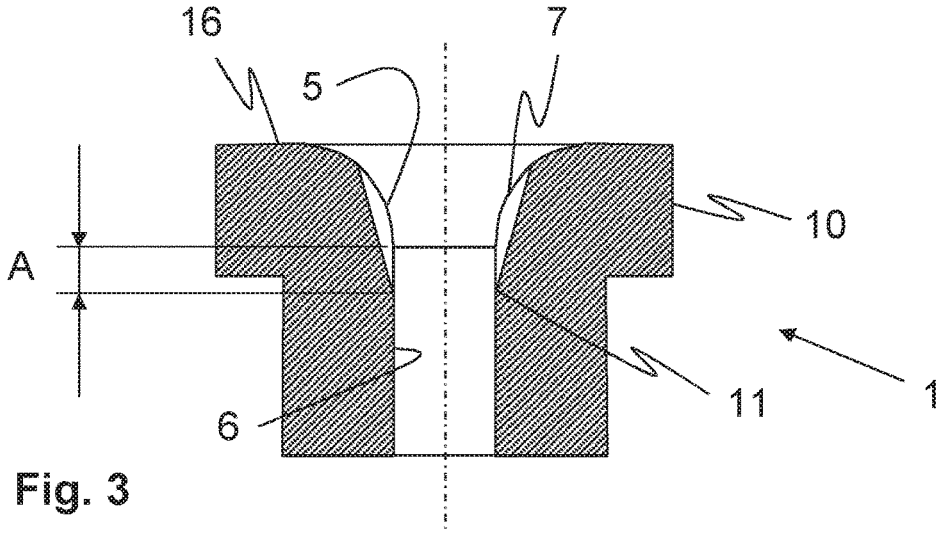
FIG. 3 is a schematic sectional view of a thread draw-off nozzle with a reduced effective diameter and with notches.

FIG. 3 shows a thread draw-off nozzle 1, which is additionally provided with notches 7, in a sectional view. Here, the notches 7 (in the present case, two notches 7 can be seen opposite one another) are arranged in the yarn deflection surface 5, but extend into the nozzle bore 6. It has proved to be particularly advantageous if the notch outlet 11, which is defined in the present case by the exit-side intersection point or the exit-side intersection line of the notch bottom 12 with the inner surface of the thread draw-off nozzle 1, is at a spacing A of between 0.1 mm and 0.5 mm away from the entrance of the nozzle bore. For example, the spacing A is 0.25 mm. With this, the entrance of the nozzle bore 6 is defined as the beginning of the constant inner cross-section of the thread draw-off nozzle 1, and in the present case is characterized by the tangential edge between the yarn deflection surface 5 and the nozzle bore 6. In the case of conventional V-shaped notches, the notch inlet 10 is in turn defined by the common intersection point of the inlet wall 8 and the baffle wall 9 with the inner surface of the nozzle funnel 5 or, in the present case, by the entrance-side intersection line of the notch bottom 12 with the inner surface of the nozzle funnel.

Figure 4:
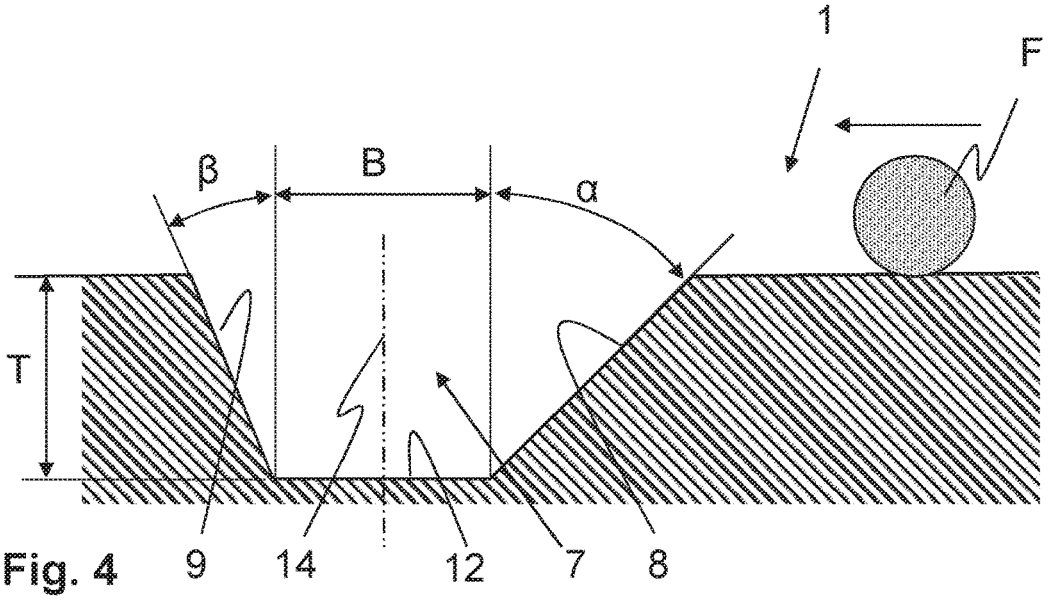
FIG. 4 is a schematic sectional view of a notch of a thread draw-off nozzle.

FIG. 4 shows a schematic section through a notch 7 of a thread draw-off nozzle 1, with which a particularly good and reliable effect of the notch 7 on the drawn-off thread F can be ensured. The notch 7 features, in a manner known per se, an inlet wall 8 and a baffle wall 9, which the thread F reaches in succession during its crank-shaped circulation over the yarn deflection surface 5. In the present case, the direction of rotation of the thread F is symbolized by an arrow. In contrast to known notch shapes, which have always been designed to be V-shaped, it is now provided that the inlet wall 8 and the baffle wall 9 do not directly adjoin one another; rather, a defined, preferably flat, notch bottom 12 with a defined width B extends between the inlet wall 8 and the baffle wall 9. The notch bottom 12 between the inlet wall 8 and the baffle wall 9 ensures that the thread F reaches the notch base or the flat notch bottom 12 in each case, and thus the notch 7 can exert its effect on the thread F. An undefined jumping of the thread F from the inlet wall 8 directly on the baffle wall 9 can thereby be avoided.

According to the present illustration, the secure reaching of the notch bottom 12 is still supported by the fact that the thread F is led over a comparatively flat inlet wall 8 slowly and gently in the direction of the notch bottom 12. The angle α to a center notch plane 14 or to a parallel thereto, as the case may be, preferably measures between 54° and 58° and is designed, for example, at 56°. The notch bottom 12 further features a width B of between 0.18 mm and 0.24 mm. For example, the width B of the notch bottom is 0.22 mm. However, the angle β of the baffle wall 9 relative to the center notch plane 14 preferably measures between 37° and 42°. According to a particularly advantageous embodiment, the angle β is 40°. This results in a notch angle of α+β between the inlet wall 8 and the baffle wall 9 of for example, 96°. It has also proved to be advantageous for the guidance of the thread F along the notch 7 if the depth T of the notch 7 is between 0.16 mm and 0.20 mm. Thus, the notch shape that is shown contributes not only to improving spinning stability, but also to improving yarn quality.

Figure 5:
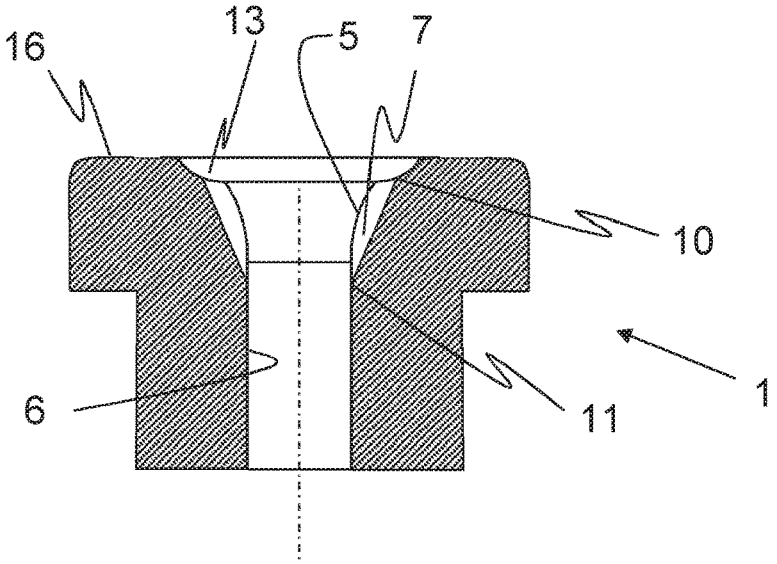
FIG. 5 is a schematic sectional view of an additional thread draw-off nozzle with a circumferential recess.

FIG. 5 shows an additional embodiment of a thread draw-off nozzle 1, with which the yarn-damaging effect of the notch inlet 10 is defused by a circumferential recess 13, in this case a circumferential groove. Thereby, the comparatively sharp transition between the curved yarn deflection surface 5 and the notch 7 can be configured to be more gentle. The circumferential groove preferably features a radius of between 0.15 mm and 0.3 mm, and in the present case extends to the front surface. However, the groove could also be designed in such a manner it only breaks up the yarn deflection surface 5.

Figure 6:
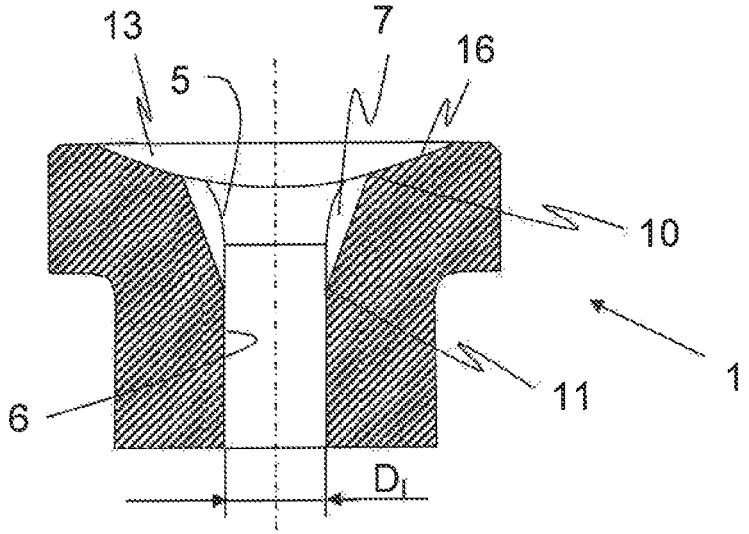
FIG. 6 is an additional embodiment of a thread draw-off nozzle with a circumferential recess.

FIG. 6 shows another embodiment of a thread draw-off nozzle 1, with which the notch inlets 10 were mitigated by a spherical recess 13. The radius of the spherical recess 13 is preferably matched to the inner diameter DI of the nozzle bore 6, and is between 0.7*DI and 0.9*DI. For example, the radius R2 is 0.8*DI. The aggressive, yarn-damaging effect of the notch inlets 10 can thereby be substantially reduced.

Figure 7:
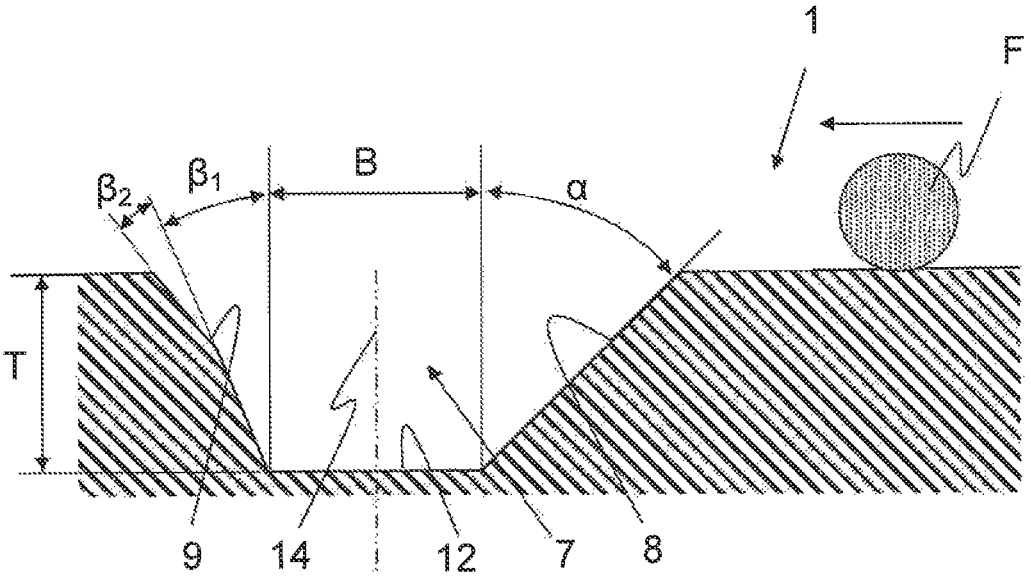
FIG. 7 is an additional embodiment of a thread draw-off nozzle with a kinked baffle wall.

In FIG. 7, a notch 7 is shown, in which the baffle wall 9 is formed to be kinked. The first part of the baffle wall 9 turned towards the notch bottom 12 is inclined at an angle $\beta_1$ to the center notch plane 14. The second part of the baffle wall 9 turned towards the edge of the thread draw-off nozzle 1 is formed to be more flat and features a second angle $\beta_2$. With this type of notch 7, a thread treatment that is more gentle than with the notches shown above is possible, since the baffle wall 9 does not brake the thread too strongly. Such a kinked formation is also possible for the inlet wall 8, in addition to or as an alternative to the kinked baffle wall 9.

It has been found that the small radius of curvature in combination with the small effective diameter $D_W$ is particularly advantageous in the case of a thread draw-off nozzle 1 provided with notches 7, since, in addition to increasing the true twist, a false twist is also introduced into the thread F. In doing so, spinning stability is further improved.

Modifications and variations can be made to the embodiments illustrated or described herein without departing from the scope and spirit of the invention as set forth in the appended claims.

LIST OF REFERENCE SIGNS

1 Thread draw-off nozzle
2 Spinning rotor
3 Rotor groove
4 Circumferential yarn shank
5 Yarn deflection surface
6 Nozzle bore
7 Notch
8 Inlet wall
9 Baffle wall
10 Notch inlet
11 Notch outlet
12 Notch bottom
13 Recess
14 Center notch plane
15 Axis of rotation of the spinning rotor
16 Front surface
17 Rotor housing
B Width of the notch bottom
T Depth of the notch
F Thread
$D_K$ Head diameter
$D_I$ Inner diameter of the nozzle bore
$D_W$ Effective diameter
A Spacing of the notch outlet from the entrance of the nozzle bore
α Angle of the inlet wall
β Angle of the baffle wall
R Radius of curvature of the yarn deflection surface
AF Emission surface

The invention claimed is:

1. A thread draw-off nozzle for an open-end rotor spinning device, comprising:
a front surface;
a nozzle bore;
a funnel-shaped yarn deflection surface connecting the front surface and the nozzle bore, the front surface adjoining the yarn deflection surface;
the front surface and the yarn deflection surface forming an effective diameter ($D_W$) of the thread draw-off nozzle;
wherein the effective diameter ($D_W$) of the thread draw-off nozzle is less than 8 mm, and the yarn deflection surface comprises a radius of curvature (R) of less than 2.5 mm; and
a head diameter ($D_K$) that is less than 10 mm.

2. The thread draw-off nozzle according to claim 1, wherein the yarn deflection surface tangentially adjoins the front surface.

3. The thread draw-off nozzle according to claim 1, wherein the yarn deflection surface comprises a plurality of macrostructures arranged in a radial manner.

4. The thread draw-off nozzle according to claim 3, wherein the macrostructures comprise notches.

5. The thread draw-off nozzle according to claim 4, wherein each notch comprises a radially outer notch inlet and a radially inner notch outlet, the radially inner notch outlets extending into the nozzle bore.

6. The thread draw-off nozzle according to claim 4, wherein each notch comprises an inlet wall and a baffle wall, wherein the baffle wall is steeper than the inlet wall relative to a notch bottom arranged between the inlet wall and the baffle wall.

7. The thread draw-off nozzle according to claim 4, wherein each notch comprises an inlet wall and a baffle wall, each notch further comprising a notch bottom arranged between the inlet wall and the baffle wall and comprising a width (B) of between 0.16 mm and 0.22 mm.

8. The thread draw-off nozzle according to claim 7, wherein an angle (β) of the baffle wall to a center notch plane is between 32.5° and 47.5°.

9. The thread draw-off nozzle according to claim 7, wherein a first angle ($\beta_1$) of a first part of the inlet wall or first part of the baffle wall to a center notch plane is between 32.5° and 47.5°, and a second angle ($\beta_2$) of a second part of the inlet wall or the baffle wall to the first part is between 10° and 20°.

10. The thread draw-off nozzle according to claim 5, wherein the yarn deflection surface comprises, at an area of the radially outer notch inlets, a circumferential recess.

11. The thread draw-off nozzle according to claim 4, wherein at least some of the notches comprise an inlet wall and a baffle wall, one or both of the inlet wall and the baffle wall being flat.

12. The thread draw-off nozzle according to claim 4, wherein some of the notches comprise an inlet wall and a baffle wall, one or both of the inlet wall and the baffle wall is kinked or bent.

13. The thread draw-off nozzle according to claim 4, wherein each notch comprises an inlet wall and a baffle wall, each notch further comprising a notch bottom arranged between the inlet wall and the baffle wall and comprising a depth (T) of the notch between 0.14 mm and 0.25 mm.

* * * * *